US007329324B2

(12) United States Patent
Boatwright et al.

(10) Patent No.: US 7,329,324 B2
(45) Date of Patent: Feb. 12, 2008

(54) STITCHLESS ON-SITE BINDING APPLICATION METHOD

(76) Inventors: Ben E. Boatwright, 18 Saddlefield Cir., Cartersville, GA (US) 30121; Kelly Huddleston, 24611 Cuchara St., La Junta, CO (US) 81050

( * ) Notice: Subject to any disclaimer, the term of this patent is extended or adjusted under 35 U.S.C. 154(b) by 137 days.

(21) Appl. No.: 10/665,467

(22) Filed: Sep. 22, 2003

(65) Prior Publication Data

US 2005/0034803 A1 Feb. 17, 2005

(51) Int. Cl.
*B32B 3/04* (2006.01)
*B32B 3/06* (2006.01)

(52) U.S. Cl. ..... 156/88; 156/227; 428/123; 428/82; 428/192; 428/99

(58) Field of Classification Search ..... 156/227; 428/183; 112/418
See application file for complete search history.

(56) References Cited

U.S. PATENT DOCUMENTS 4,054,698 A * 10/1977 Hamrah ..... 428/41.8
4,724,327 A * 2/1988 Mitchell ..... 250/483.1
4,859,524 A * 8/1989 Kim et al. ..... 442/35
6,258,202 B1 * 7/2001 Callas ..... 156/293
2001/0001300 A1 * 5/2001 Tolbert et al. ..... 442/60
2002/0102376 A1 * 8/2002 Ang et al. ..... 428/40.1

* cited by examiner

*Primary Examiner*—Richard Crispino
*Assistant Examiner*—Barbara J. Musser
(74) *Attorney, Agent, or Firm*—Lowe Hauptman Ham & Berner LLP

(57) ABSTRACT

On-site binding for carpets and the like wherein a covered welting material is provided with a strip with adhesive on both sides. One side is covered with peel-off wax paper which is removed to adhere the welting material flush against the edge of the carpet's pile. The adhesive underside of the paper has an extension of the welting material adhered thereto. A thermal plastic glue is applied between the carpet pile and welting material whereby the welting material binding is secured the carpet by the underlying strip (with adhesive on both sides) and the thermalplastic bead.

28 Claims, 2 Drawing Sheets

METHOD OF APPLICATION

STEP1: PEEL WAX PAPER TO EXPOSE GLUED SIDE OF BINDER.

STEP2: ATTACH TO BOTTOM OF CARPET AND ABUT CORD TO SIDE OF CARPET.

STEP3: SEPARATE CORD FROM EDGE AND APPLY A BEAD OF THERMOPLASTIC GLUE USING A HOT GLUE GUN.

STEP4: ATTACH EDGE BINDING TO EDGE OF CARPET BY FOLDING THEM TOGETHER TO FORM A SEALED BOND.

STITCHLESS ON-SITE BINDING APPLICATION METHOD

RELATED APPLICATIONS

The priority benefits of Provisional Application Ser. No. 60/411,347, filed Sep. 18, 2002, and International Application No. PCT/US03/20418, filed Jun. 30, 2003, based on Provisional Application No. 60/392,261, filed Jul. 1, 2002, are claimed.

FIELD OF THE INVENTION

The present invention relates to the field of binding, particularly a stitchless on-site binding application for finishing the cut edge of a piece of material such as carpet.

BACKGROUND OF THE INVENTION

Cut carpet edges are known to fray and delaminate at the edge if they are not finished or bound in some manner. Custom fitted carpets commonly referred to in the art as "wall to wall" are ordinarily tacked down along the edge of a wall or other boundary using a tack down strip or similar device to bind the unfinished edge of a carpet against a boundary such as wall or molding. Carpets which are not fitted to a boundary such as a wall, should be bound at the edge to prevent fraying of the cut carpet pile, delaminating of the carpet edge construction, and general degradation of the carpet end due to normal wear and tear.

Carpet bindings are known in the art designed to finish the edges of carpets and carpeting which are to be fitted not in a wall-to-wall manner and therefore have edges exposed to ordinary wear and tear. Area carpets placed on a wood floor are often not fitted wall-to-wall and the edges thereof are ordinarily bound by a stitched binding method using carpet binding methods and materials known in the art.

U.S. Pat. No. 2,037,511, to Jackson, discloses a carpet binding wherein a pocket is created by folding a piece of fabric over itself on one end using either adhesive or stitching, or both, inserting a metal bar into the pocket and stitching the end of the pocket to prevent sliding or dislocation of the metal bar. The weighted metal bar prevents curling of the carpet end.

United States patents and at least one International published application disclose carpet bindings and welting materials and methods for finishing the edge of a piece of material such as carpet. Reference is made to U.S. Pat. Nos. 1,879,258, to Howard; U.S. Pat. No. 324,082, to Charmbury; Reissue 36,636, to Sturm et al; U.S. Pat. No. 4,724,327, to Mitchell; U.S. Pat. No. 2,066,545, to Shuttleworth; U.S. Pat. No. 2,855,027, to Bank; U.S. Pat. No. 3,592,720, to Wattles et al; and International Publication No. WO 88/06666, to Jodeit et al. In each case, similar to U.S. Pat. No. 2,037,511, to Jackson, the use of stitching is encouraged or required to secure the binding material in a manner designed to improve the bind.

Stitched bindings on carpet edges provide a secure bind and at the same time provide a uniform finished look for aesthetic appeal and greater value. However, due to the thick nature of the backing material used to manufacture carpets, a strong needle is required to sew binding on carpet. Therefore carpet bindings are constructed on heavy duty sewing machines in a factory or commercial establishment prior to the finished product being delivered to the home, office, or final installation location.

The installation of custom wall-to-wall carpets often results an excess amount of carpet waste due to the oversizing required to fit the carpet wall-to-wall and the natural widths which the carpet material is manufactured and rolled. This excess carpet is frequently saved by the consumer and used for small area rugs, cut to fit closet interiors, and can be cut to fit the central-used portion treads and rises of a stairway. However, the unfinished edges of these excess carpet pieces, also know as remnants when sold as the large last section of a carpet roll, are not bound and are therefore subject to the aforementioned problems of fraying, delaminating, and degradation. Customers can request that remnants be bound for them prior to installing. The cost of binding a carpet with a traditional stitched binding is currently typically about one to two dollars per foot. Once presented with sufficient remnants to install an area such as a stairway, customers have an option of resending the carpet pieces to the factory for custom binding. The cost associated with a second delivery and the additional cost of the binding may be avoided if carpet installers can readily provide a stitchless on-site binding application performed at the installation location without the need for custom sewing or machinery or the extra time associated with a second delivery.

SUMMARY OF THE INVENTION

It is an object of this invention to provide a method and materials for binding the edge of a carpet which improves upon binding methods known in the prior art and the disadvantages of the known methods that require stitching to prevent fraying, delaminating, and degradation. The instant invention binds without the requirement of stitching at the installation location using a method which is easily applied and transportable to any location thereby making it less expensive and easier to make a finished edge on carpet remnants and provide a finished bound edge on carpeting.

It is a further object of this invention to provide a method and materials to carpet installers for customizing the ends of unfinished carpets with a quick and easy stitchless on-site binding application that can be color-coordinated to match different carpet colors and coordinated to offer different binding sizes and textures for greater aesthetic appeal.

Another feature of this invention is the stitchless on-site binding material comprising a double-sided adhesive means which secures the bound edge to the carpet adjacent to the carpet material terminus and which also secures the bottom edge of the carpet or otherwise tends, to immobilize it onto the floor or substrate on which the carpet rests.

The welt material may also be formed from any commercially prefabricated edge material using conventional binding means such a stitching or adhesive, for example, a sewn rope or fringe which may next be affixed onto the binding fabric using the disclosed invention. The binding fabric with the prefabricated welted material is bound to the exposed edge of the carpet using the stitchless on-site binding application described herein.

The on-site binding is doubly secured to the adjacent carpet material by the application of a thermoplastic glue between the carpet material and the welt material above the adhesive means which connects and underlies the welt material and the carpet material.

DETAILED DESCRIPTION OF THE PREFERRED EMBODIMENTS OF THE INVENTION

Figure 1:
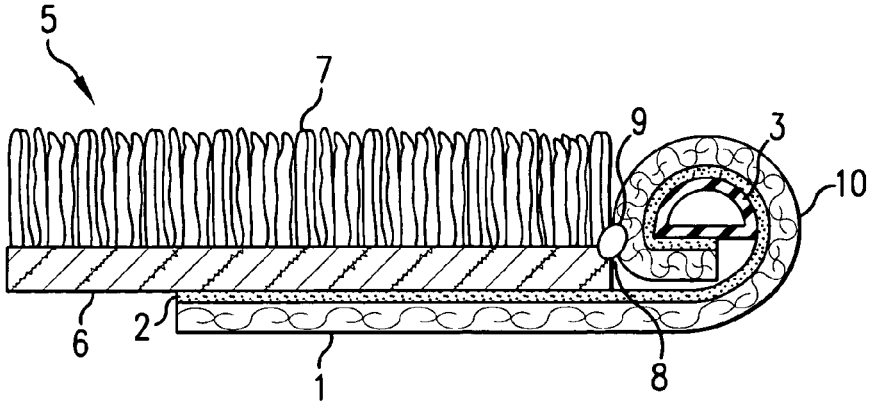
FIG. 1 is a side elevation view of a carpet with the stitchless binding device installed.
Figure 2:
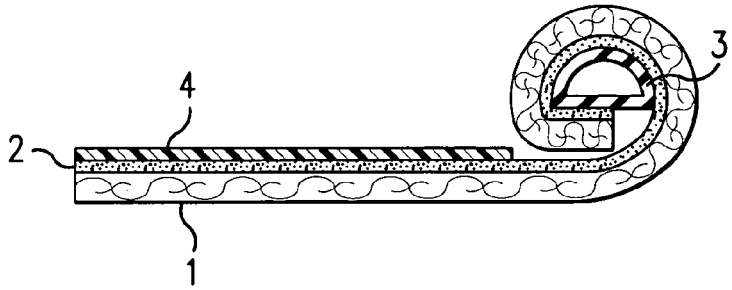
FIG. 2 is a side elevation view of the stitchless binding device without the carpet material to be bound.

Referring now to the drawings, and particularly FIGS. 1 and 2 is a side elevation view of the stitchless binding device for finishing a material comprising a carpet having a pile 7. It will be appreciated, however, that the binding device can be used on upholstery, window treatments such as cornices, pillows, and other materials requiring binding to finish an edge.

Binding fabric 1 is covered with a double-face adhesive layer 2 on at least one side. Double-face adhesive layer 2 is commonly referred to as a "peel and stick" double-face tape with adhesive coatings on both sides covered by a thin non-stick peelable film 4. The width of the binding fabric is approximately two and one-half inches (2½) although different widths may be used depending on the application and materials used.

Welt material 3 is pre-formed from a flexible material such a rubber into a semi-circular shape and is readily available in preformed rolls used for binding which is traditionally stitched to the edge of a carpet 5. Adhesive layer 2 is partially exposed to allow the end of the joined layers of binding fabric 1 and adhesive layer 2 to secure and stick to the covered welt material 3 as shown in FIGS. 1 and 2. However, a preferred method of securing the formed welt 10 to backing 6 is illustrated in FIGS. 3 and 6-8, wherein adhesive layer 2 is secured preferable about the middle or mid-point of the diameter of the flat side of the covered welt material 3. Welt material 3 may have an adhesive pre-applied to its flat side for easier securing to the fabric and stronger adhesive seal. The combined welting material 3 together with the binding fabric 1 and adhesive layer 2 is rolled over to secure welt material 3 in an upright position with the curved portion topside creating a rounded edge with, as seen in the FIG. 3 embodiment, a flat bottom. This step can be conducted on site in the situation where a seldom-used color or binding fabric or welting material is used. In the instances where common binding fabric colors and welting material are used, the structure shown in FIG. 2 or FIG. 3, can be prepared in advance in anticipation of later use by the disclosed method or methods already known in the art. For example, welting material 3 can also be sewn into binding fabric 1 or secured by adhesive which is not a peel and stick double face variety. However, the peel and stick double face tape is adhered to the binding fabric 1 from the inner edge of the welting/binding fabric formed for subsequent adhering to the carpet or material to be bound.

Referring now to FIG. 1, carpeting or material 5 comprises backing 6 (primary and secondary) and pile material 7. To begin the binding process of material 5, the peel and stick plastic coating 4 is removed to expose the adhesive 2. Backing 6 of material 5 is placed onto adhesive 2 being careful to abut the edge of pile 7 to the interior portion of the formed welt 10 at edge location 8 thereby creating an artificial boundary which serves to protect against degradation. A bead of thermoplastic adhesive 9 is placed in-between the welt 10 at edge location 8 and the ends of pile 7 further securing the binding. Thermoplastic adhesive 9 may be pre-applied to welt 10. During installation the pre-applied thermoplastic adhesive 9 may be activated by a heating means designed to melt the adhesive to allow the welting material and the edge of the carpet to become bound. Heating means could comprise irons, hot-air blowers, and non-heat radiation applied to an element contained within the thermoplastic designed to melt the thermoplastic by radiation such as a microwave. In the latter embodiment a metal element is contained within or against the thermoplastic 9 and activated by a radiating means which causes the element to heat and thereby melt the thermoplastic.

Figure 3:
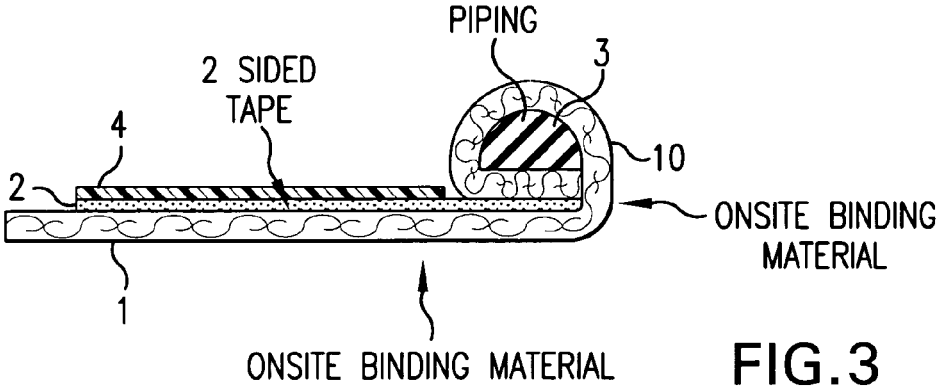
FIG. 3 is similar to FIG. 2 including, however, the addition of protective wax paper above and below the two-sided adhesive tape.

FIGS. 3 and 6-8 illustrate the method of applying the invention to the edge of a carpet or the like. Thus in FIG. 3 the invention as ready for installation on a carpet or like is shown wherein the two-sided tape 2 is covered by wax paper 4. For insulation, tape 4 is removed thus exposing adhesive 2 applied to fabric 1. Both fabric 1 with adhesive layer 2 thereon being secured under welt 10 with fabric 1 being wrapped around piping 3. This structure, as shown in FIG. 3, is then placed under backing 6 of carpeting 5 so that backing 6 is secured to fabric 1 via adhesive 2. Thermal plastic is then applied between welt 10 pile material 7 at location 8. The glue is preferably, as previously indicated, thermoplastic glue and is applied with a hot glue gun. Then welt 10 is folded together against the edge of carpeting 5 from the position shown in FIG. 7 to that shown in FIG. 8, and allowed to cure (usually about 5 to 10 seconds) to form a secured bond.

Figure 4:
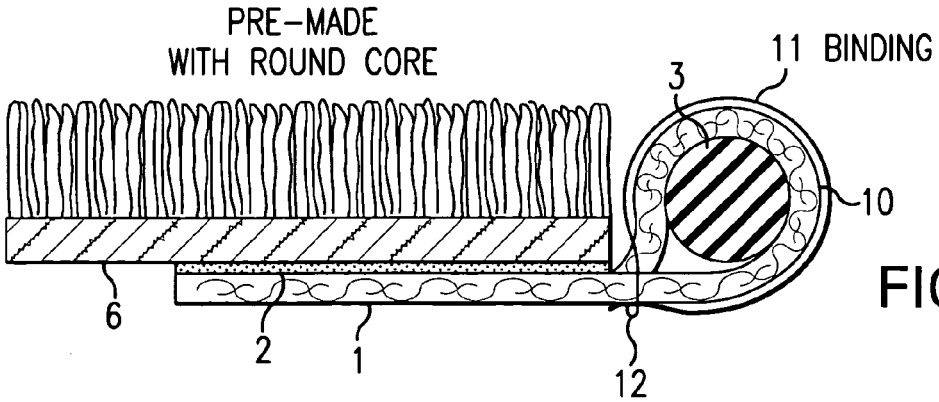
FIG. 4 is also similar to FIG. 2, which disposes an alternative cylindrical piping in place of the "D" piping shown in FIGS. 2 and 3.
Figure 5:
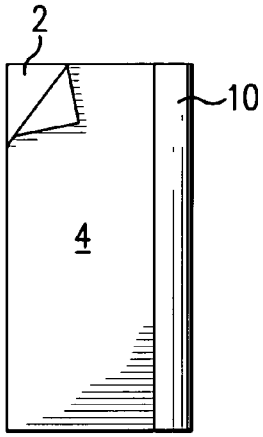
FIG. 5 is a plan view of the peel-away wax paper which covers the two-sided adhesive tape.
Figure 6:
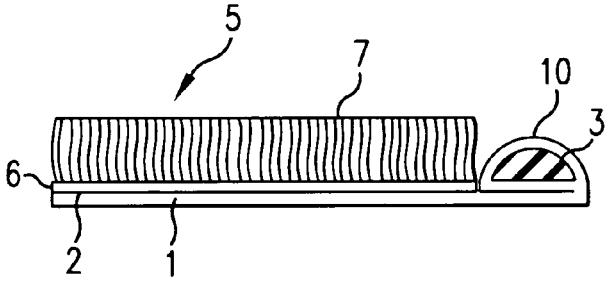
FIG. 6 is similar to FIG. 1 without, however, the thermalplastic glue having been applied.
Figure 7:
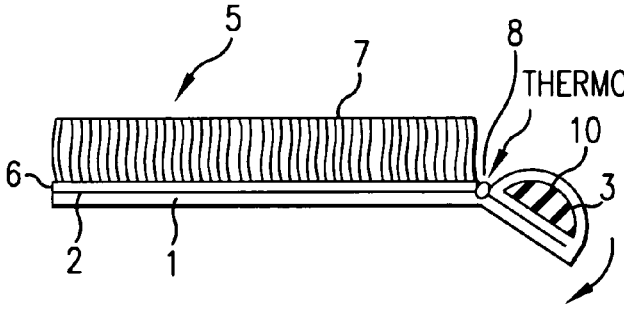
FIG. 7 is the same as FIG. 6 illustrating, however, the binding material bent over to receive the thermal plastic glue which is introduced between the carpet backing and lower part of the carpet pile by a hot glue gun.
Figure 8:
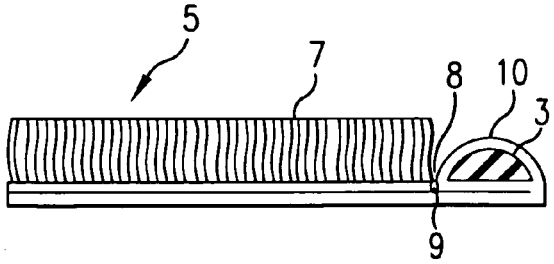
FIG. 8 illustrates the next step following the introduction of the glue shown in FIG. 7, wherein the binding is folded against the carpet backing and lower portion of the carpet pile to form a sealed bond which, with the thermalplastic glue being cured, forms the final product.

FIG. 4 shows a somewhat different embodiment wherein piping 3 is cylindrical in shape, thus having a circular cross-section and welt 10 includes a binding 11 which is secured to fabric 1 by being pre-sewn thereto by stitching 12. This structure is prepared by the manufacturer and then applied on site in the same manner as shown for the structure in FIG. 3.

The product and method of applying the binding to carpeting is currently being advertised using the trademark "INSTABIND." On the Internet at http://www.instabind-.com and the disclosure of such advertising is incorporated herein by reference. Copies of such material published on the Internet are submitted herewith for information.

The flexible stitchless on-site binding disclosed can be used via the wrap-curl steps or otherwise bent and curved to address form-fitting applications such as bull-nose shapes and upholstery forms. Additional embodiments of this invention can be used to incorporate fringe instead of binding fabric and welting. Further, the adhesive means can be alternated with methods known in the art such as Velcro, iron-on adhesive and hot glue. The advantages of the instant invention are designed to allow for quick and portable binding in a secure and attractive manner without the costs ad time associated with traditional known binding means and devices.

Binding fabric 1 may have a non-slip bottom surface or may be eliminated whereupon layer 2 abuts the supporting surface in which case the bottom of layer 2 may have a non-slip surface applied thereto as well as a bead 9 of thermoplastic also applied thereto in the manufacturing step or on-site.

The foregoing disclosure illustrates the preferred embodiments of the invention; however, concepts as based upon the disclosure, may be employed in other embodiments without departing from the scope of the invention. Accordingly the following claims are intended to protect the invention broadly, as well in the specific forms shown.

Having disclosed our invention what we claim as new and to be secured by Letters Patent of the United States of America is:

1. A method of binding an edge to the side of a carpet which comprises the steps of: securing a piece of binding material to said edge so that it extends outwardly along one side of said edge; attaching said piece by an adhesive to an underside of said carpet so that said one side of said edge abuts said side of said carpet; applying a bead of glue between said side of said carpet and said one side of said edge; and permitting said glue to cure whereby said side of said carpet and said one side of said edge are bonded together.

2. A method in accordance with claim 1, wherein said piece of binding material is attached to the underside of said carpet by disposing a planar material between the bottom of said carpet and said piece of binding material, said planar material having an adhesive on both sides thereof wherein the adhesive on the upper of said both sides attaches said piece to said underside.

3. A method in accordance with claim 1, wherein said bead of glue is composed of a thermal plastic adhesive.

4. A method in accordance with claim 1, wherein said bead of glue is applied between said side of said carpet and said one side of said edge by a hot glue gun.

5. A method in accordance with claim 1, wherein the step of securing said binding material on said edge comprises wrapping the binding material around a welt material.

6. A method in accordance with claim 5, wherein said welt material is substantially circular in cross-section.

7. A method in accordance with claim 1, which includes the step of increasing an angle between said side of said carpet and said one side of said edge to receive said bead of glue when said bead of glue is applied thereto and then decreasing said angle before said bead of glue has cured to produce a strong durable bond between said carpet and said edge.

8. A method in accordance with claim 2, wherein a protective material on the upper side of said planar material is removed before said planar material is secured by said adhesive to the bottom of said carpet.

9. A method in accordance with claim 1, wherein said binding material comprises cord.

10. A method in accordance with claim 5, wherein the step of securing said binding material on said edge comprises the further step of stitching said binding material so that it encircles said welt material.

11. A method in accordance with claim 3, wherein a metal element is included within or against said thermal plastic adhesive, said thermal plastic adhesive being subjected to radiation which causes said metal element to heat and thereby melt the thermal plastic adhesive.

12. A method in accordance with claim 1, wherein said binding material comprises piping.

13. A method in accordance with claim 5, wherein said welt material consists of welt material which is substantially circular in cross-section or welt material which is substantially D-shaped in cross-section or a combination thereof.

14. A method of applying a binding an edge of a material without stitching the binding to the material, the binding to said material comprising a binding fabric adhered on at least one side with double-sided adhesive tape, forming a pocket surrounding a welt component on one side of said binding fabric by folding said fabric over said welt component, said binding fabric and said adhesive tape to form a welt, securing said material to be bound to said binding fabric by said adhesive tape extending from said binding fabric, the end of said material substantially abutting said welt formed over said adhesive tape, and applying a bead of thermal plastic adhesive in-between said material and the welt formed and over said adhesive tape.

15. A method of applying a binding an edge to a material without stitching the binding to the material, the binding to be applied to said material comprising a binding fabric having on at least one side a double-sided adhesive tape, a welt substance secured in a pocket formed by said binding fabric on one side of said binding fabric by folding over on itself, said binding fabric and said adhesive tape, and securing said material to said binding fabric by said adhesive tape extending from said binding fabric, the end of said material substantially abutting a welt formed over said adhesive tape, applying in-between said material and the welt formed and over said adhesive tape a bead of thermal plastic adhesive.

16. A method of binding an edge to a vertical side of a carpet which comprises the steps of: securing a piece of binding material to said edge so that it extends outwardly along one side of said edge; attaching said piece by an adhesive to an underside of said carpet so that said edge abuts said vertical side of said carpet; applying a bead of glue between said vertical side of said carpet and said edge; and permitting said glue to cure whereby said vertical side of said carpet and said edge are bonded together without said edge being over the upper adjacent surface of said carpet.

17. A method in accordance with claim 16, wherein said piece of binding material is attached to the underside of said carpet by disposing a planar material between the bottom of said carpet and said piece of binding material, said planar material having an adhesive on both sides thereof wherein the adhesive on the upper of said both sides attaches said piece to said underside.

18. A method in accordance with claim 16, wherein said bead of glue is composed of a thermal plastic adhesive.

19. A method in accordance with claim 16, wherein said bead of glue is applied between said vertical side of said carpet and said edge by a hot glue gun.

20. A method in accordance with claim 16, wherein the step of securing said binding material to said edge comprises wrapping the binding material around a welt substance.

21. A method in accordance with claim 20, wherein said welt material is substantially circular in cross-section.

22. A method in accordance with claim 16, which includes the step of increasing an angle between said vertical side of said carpet and said edge to receive said bead of glue when said bead of glue is applied thereto and then decreasing said angle before said bead of glue has cured to produce a strong durable bond between said carpet and said edge.

23. A method in accordance with claim 17, wherein a protective material on the upper side of said planar material is removed before said planar material is secured by said adhesive to the bottom of said carpet.

24. A method in accordance with claim 16, wherein said binding material comprises cord.

25. A method in accordance with claim 20, wherein the step of securing said binding material to said edge comprises the further step of stitching said binding material so that it encircles said welt substance.

26. A method in accordance with claim 18, wherein a metal element is included within or against said thermal plastic adhesive, said thermal plastic adhesive being subjected to radiation which causes said metal element to heat and thereby melt the thermal plastic adhesive.

27. A method in accordance with claim 16, wherein said binding material comprises piping.

28. A method in accordance with claim 20, wherein said welt substance consists of welt substance which is substantially circular in cross-section or welt substance which is substantially D-shaped in cross-section or a combination thereof.

* * * * *

UNITED STATES PATENT AND TRADEMARK OFFICE

CERTIFICATE OF CORRECTION

PATENT NO. : 7,329,324 B2
APPLICATION NO. : 10/665467
DATED : February 12, 2008
INVENTOR(S) : Boatwright et al.

It is certified that error appears in the above-identified patent and that said Letters Patent is hereby corrected as shown below:

On the Title page:

addition of the following omitted information on the face of the patent:

(22) PCT Filed: June 30, 2003

(86) PCT No.: PCT/US2003/020418

(87) PCT Pub. No.: WO 2004/008921 A1

PCT Pub. Date: Jan. 29, 2004

Related U.S. Application Data

(60) Provisional application No. 60/392,261, filed on July 1, 2002.
Provisional application No. 60/411,347, filed on Sept. 18, 2002.

Signed and Sealed this

Seventh Day of December, 2010

David J. Kappos

David J. Kappos
*Director of the United States Patent and Trademark Office*